US009930456B2

(12) United States Patent
Recker et al.

(10) Patent No.: US 9,930,456 B2
(45) Date of Patent: Mar. 27, 2018

(54) METHOD AND APPARATUS FOR LOCALIZATION OF STREAMING SOURCES IN HEARING ASSISTANCE SYSTEM

(71) Applicant: Starkey Laboratories, Inc., Eden Prairie, MN (US)

(72) Inventors: Karrie LaRae Recker, Edina, MN (US); Eric A. Durant, Milwaukee, WI (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/443,684

(22) Filed: Feb. 27, 2017

(65) Prior Publication Data

US 2017/0171672 A1 Jun. 15, 2017

Related U.S. Application Data

(63) Continuation of application No. 14/841,301, filed on Aug. 31, 2015, now Pat. No. 9,584,933, which is a (Continued)

(51) Int. Cl.
*H04R 25/00* (2006.01)
*H04S 1/00* (2006.01)
(Continued)

(52) U.S. Cl.
CPC ..... *H04R 25/552* (2013.01); *H04R 25/407* (2013.01); *H04S 1/005* (2013.01);
(Continued)

(58) Field of Classification Search
CPC .... H04R 25/70; H04R 25/356; H04R 25/402; H04R 25/405; H04R 25/407;
(Continued)

(56) References Cited

U.S. PATENT DOCUMENTS 5,785,661 A 7/1998 Shennib
6,243,476 B1 6/2001 Gardner
(Continued)

FOREIGN PATENT DOCUMENTS

EP 2584794 A1 4/2013
EP 2736276 A1 5/2014
(Continued)

OTHER PUBLICATIONS

"U.S. Appl. No. 13/927,799, Non Final Office Action dated Nov. 4, 2014", 10 pgs.
(Continued)

*Primary Examiner* — Brian Ensey
(74) *Attorney, Agent, or Firm* — Schwegman Lundberg & Woessner, P.A.

(57) ABSTRACT

A hearing assistance system streams audio signals from one or more streaming sources to a hearing aid set and enhances the audio signals such that the output sounds transmitted to the hearing aid wearer include a spatialization effect allowing for localization of each of the one more streaming sources. The system determines the position of the hearing aid set relative to each streaming source in real time and introduces the spatialization effect for that streaming source dynamically based on the determined position, such that the hearing aid wearer can experience a natural feeing of the acoustic environment.

20 Claims, 5 Drawing Sheets

Related U.S. Application Data continuation of application No. 13/927,799, filed on Jun. 26, 2013, now Pat. No. 9,124,983.

(51) Int. Cl.
*H04R 5/033* (2006.01)
*H04R 5/04* (2006.01)

(52) U.S. Cl.
CPC ..... *H04R 5/033* (2013.01); *H04R 5/04* (2013.01); *H04R 25/505* (2013.01); *H04R 2205/041* (2013.01); *H04R 2225/55* (2013.01); *H04R 2460/07* (2013.01); *H04S 2420/01* (2013.01)

(58) Field of Classification Search
CPC .. H04R 25/502; H04R 25/505; H04R 25/552; H04R 25/554; H04R 25/558; H04R 2225/41
USPC ..... 381/312, 313, 314, 315
See application file for complete search history.

(56) References Cited

U.S. PATENT DOCUMENTS

| | | | | |
|---|---|---|---|---|
| 6,961,439 | B2 | 11/2005 | Ballas | |
| 7,853,030 | B2 | 12/2010 | Grabson et al. | |
| 8,249,461 | B2 | 8/2012 | Vaerndal | |
| 9,124,983 | B2 | 9/2015 | Recker et al. | |
| 9,584,933 | B2 | 2/2017 | Recker et al. | |
| 2008/0008341 | A1* | 1/2008 | Edwards | H04R 25/552 381/315 |
| 2010/0092017 | A1 | 4/2010 | Waldmann | |
| 2011/0188662 | A1 | 8/2011 | Jensen et al. | |
| 2012/0063610 | A1* | 3/2012 | Kaulberg | H04R 25/407 381/71.1 |
| 2012/0072206 | A1 | 3/2012 | Tsuchinaga et al. | |
| 2012/0128184 | A1 | 5/2012 | Kim et al. | |
| 2013/0094683 | A1* | 4/2013 | Hansen | G09B 21/04 381/309 |
| 2013/0157573 | A1* | 6/2013 | Aldaz | H04W 4/008 455/41.2 |
| 2015/0003653 | A1 | 1/2015 | Recker et al. | |
| 2016/0066103 | A1 | 3/2016 | Recker | |

FOREIGN PATENT DOCUMENTS

| | | | |
|---|---|---|---|
| WO | WO-0155833 | A1 | 8/2001 |
| WO | WO-2007112756 | A2 | 10/2007 |
| WO | WO-2010086462 | A2 | 8/2010 |

OTHER PUBLICATIONS

"U.S. Appl. No. 13/927,799, Notice of Allowance dated Apr. 27, 2015", 5 pgs.
"U.S. Appl. No. 13/927,799, Respnse filed Mar. 4, 2015 to Non Final Office Action dated Nov. 4, 2014", 11 pgs.
"U.S. Appl. No. 14/841,301, Non Final Office Action dated Jun. 16, 2016", 12 pgs.
"U.S. Appl. No. 14/841,301, Notice of Allowance dated Oct. 21, 2016", 5 pgs.
"U.S. Appl. No. 14/841,301, Preliminary Amendment filed Dec. 4, 2015", 6 pgs.
"U.S. Appl. No. 14/841,301, Response filed Sep. 16, 2016 to Non Final Office Action dated Jun. 16, 2016", 9 pgs.
"European Application Serial No. 14173525.8, Examination Notification Art. 94(3) dated May 17, 2016", 6 pgs.
"European Application Serial No. 14173525.8, Extended European Search Report dated Nov. 3, 2014", 7 pgs.
"European Application Serial No. 14173525.8, Response filed Jun. 30, 2015 to Extended European Search Report dated Nov. 3, 2014", 19 pgs.
"What is MIMO? Multiple Input Multiple Output Tutorial", [Online]. Retrieved from the Internet: <URL: https://web.archive.org/web/20120815030147/http://www.radio-electronics.com/info/antennas/mimo/multiple-input-multiple-output-technology-tutorial.php>, (Archived Aug. 15, 2012), 5 pgs.
Brown, C. Phillip, et al., "A structural model for binaural sound syntheses", IEEE Transactions on Speech and Audio Processing vol. 6, No. 5, (Sep. 1998), 476-488.
Ellinger, F., et al., "Local Positioning for Wireless Sensor Networks", Globecom Workshops, Institute of Electrical and Electronics Engineers,, (Nov. 2007), 1-6.
Golson, Jordan, "iPhone 4S Includes Significant Antenna Upgrades", MacRumors, [Online]. Retrieved from the Internet: <URL: http://www.macrumors.com/2011/10/04/iphone-4s-includes-significant-antenna-upgrades/>, (Oct. 4, 2011), 8 pgs.
Vossiek, Martin, "Wireless Local Positioning", IEEE Microwave Magazine, (Dec. 2003), 77-86.

* cited by examiner

METHOD AND APPARATUS FOR LOCALIZATION OF STREAMING SOURCES IN HEARING ASSISTANCE SYSTEM

RELATED APPLICATION

This application is a continuation of U.S. patent application Ser. No. 14/841,301, filed Aug. 31, 2015, which is a continuation of U.S. patent application Ser. No. 13/927,799, filed on Jun. 26, 2013, now issued as U.S. Pat. No. 9,124,983, each of which applications are incorporated herein by reference in their entirety.

TECHNICAL FIELD

This document relates generally to hearing assistance systems and more particularly to a system that spatially enhances an audio signal streamed to listening devices such as hearing aids to allow for real-time localization of a streaming source.

BACKGROUND

Hearing assistance devices include a variety of devices such as assistive listening devices, cochlear implants and hearing aids. Hearing aids are useful in improving the hearing and speech comprehension of people who have hearing loss by selectively amplifying certain frequencies according to the hearing loss of the subject. A hearing aid typically includes a microphone, an amplifier and a receiver (speaker). The microphone receives sound (acoustic signal) and converts it to an electrical signal and sends it to the amplifier. The amplifier increases the power of the signal, in proportion to the hearing loss, and then sends it to the ear through the receiver. Cochlear devices may employ electrodes to transmit sound to the patient.

Wireless communication technology such as Bluetooth provides hearing assistance devices with capability of wirelessly connecting to telephones, television sets, computers, music players, and other devices with audio output using a streaming device. Examples of wireless hearing assistance systems include wireless hearing aids and a streaming device that transmits sound from an audio source to the wireless hearing aids. Such wireless hearing aids when connected to streaming devices function like wireless headphones, which typically do not allow the wearers to locate the source of sound.

Under some circumstances, however, it is desirable for a user of a wireless hearing assistance device to identify and/or locate the source of the sound being heard. Wireless hearing aids worn by a patient suffering hearing loss is an example where the user (patient) may desire spaciousness for the sound being heard, such that the sound is heard as being from its source rather than occurring inside the user's ear.

SUMMARY

A heating assistance system streams audio signals from one or more streaming sources to a hearing aid set and enhances the audio signals such that the output sounds transmitted to the hearing aid wearer include a spatialization effect allowing for localization of each of the one more streaming sources. The system determines the position of the hearing aid set relative to each streaming source in real time and introduces the spatialization effect for that streaming source dynamically based on the determined position, such that the hearing aid wearer can experience a natural feeing of the acoustic environment.

In one embodiment, a hearing assistance system for transmitting sounds to a user includes a streaming source, a hearing aid set, a positioning system, and a spatialization processor. The streaming source is configured to produce an audio signal and stream the audio signal to the hearing aid set. The heating aid set is configured to be communicatively coupled to the streaming source via a wireless link to receive the streamed audio signal, process the streamed audio signal to produce output sounds, and transmit the output sounds to the user. The output sounds have a spatialization effect allowing the user to locate the streaming source. The positioning system is configured to determine the position of the hearing aid set relative to the streaming source in real time. The spatialization processor is configured to process the audio signal using the position of the hearing aid set relative to the streaming source such that the output sounds include the spatialization effect.

In one embodiment, a method for transmitting sounds to a user is provided. An audio signal is streamed to a hearing aid set from a streaming source. Output sounds are produced using the audio signal and to the user using the hearing aid set. A position of the hearing aid set relative to the streaming source is determined in real time. The audio signal is enhanced using the position of the hearing aid set relative to the streaming source such that the output sounds include a spatialization effect allowing the user to locate the streaming source.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
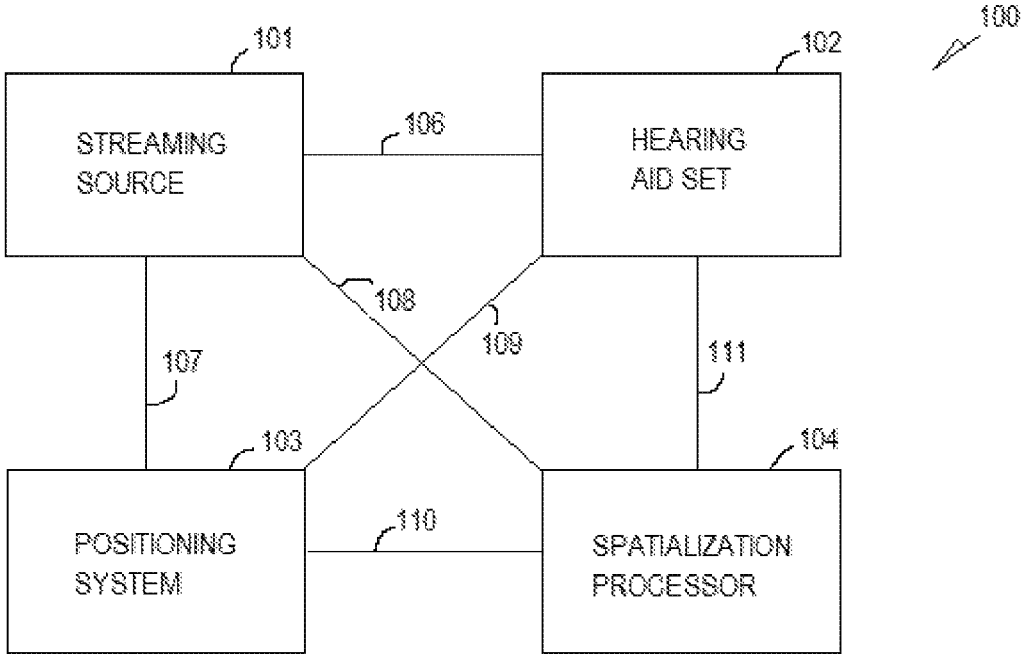
FIG. 1 is a block diagram illustrating an embodiment of a hearing assistance system providing for spatial enhancement of streamed audio.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses an apparatus and method for spatially enhancing streamed audio including real-time localization of streaming sources for wireless hearing assistance devices such as wireless hearing aids. Examples of wireless heating assistance systems include wireless hearing aids and streaming devices such as SurfLink® Mobile and SurfLink® Media provided by Starkey Laboratories, Inc, (Eden Prairie, Minn., U.S.A.). SurfLink® Mobile provides hearing aid wearers with true hands-free conversations, and integrates functions of cell phone transmitter, assistive listening device, media streamer, and hearing aid remote control. It wirelessly streams sound from any Bluetooth enabled audio source to hearing aids. SurfLink® Media provides hearing aid wearers with "set-and-forget" media streaming that transmits stereo sound from an audio source to any. SurfLink® compatible hearing aids in range without paring or body-worn relay devices. It enables multiple hearing aid wearers to connect to a single audio source device, and streams audio to SurfLink® compatible hearing aids upon their entrance into the streaming device's wireless communication range.

Currently when streaming audio to wireless hearing aids, such as from SurfLink® Mobile and SurfLink® Media, the audio is presented to the hearing aid wearer diotically (i.e., the same signal is streamed to both right and left hearing aids) or in stereo (i.e., a left channel signal is streamed to a left hearing aid and a right channel signal is streamed to a right hearing aid). While both of these options can provide improved audibility and improved sound quality over a monaural signal or a signal that is not being streamed, they do not provide the same auditory perception that a person with normal hearing would experience in the same environment. For example, the acoustics of the environment as perceived by the person with normal hearing change when that person turns his head or moves in space, but the wireless hearing aid wearer would not perceive such change.

Efforts have been made to improve spaciousness of a sound (i.e., to make it sound as if it is coming from a specific source in a location outside the listener's head). Various techniques have been proposed. For example, to make a sound appear to originate from a particular direction, time delays and/or level differences can be introduced to the signals that represent the sound and are presented to the two ears of the listener. The time delays and/or level differences can be implemented in a simple manner, for example by having all sounds that are presented to one ear delayed by a certain amount of time or decreased in level by a certain decibel amount. The time delays and/or level differences can also be implemented in a more complex manner for a more realistic listening experience. In one example, the phase and/or the level of the sound signals that are presented to the two ears of the listener are varied on a frequency-specific basis. Such an implementation may incorporate the listener's head-related transfer function (HRTF), which is a response that characterizes how an ear receives sound from a point in space. An HRTF captures changes to the sound source that occur due to the listener's head and torso. Generally, incorporating HRTFs into a simulated acoustic environment produces a greater sense that the signal is occurring somewhere in space than does manipulating the acoustic signal using simple time delays or level differences. In order to improve the naturalness of the sound, and to make the sound appear as if it is occurring outside the listener's head, reverberation can also be added to the signal.

While these spatialization techniques have been proposed for improving the spaciousness of a sound, when applied for hearing aids they have limitations resulting from their static nature. When the hearing aid wearer and/or the sound/streaming source move in space, the acoustics of the streamed audio signal do not change accordingly. Such static nature is not what a person with normal hearing would experience in most realistic environments (except, for example, when the person uses wireless headphones). The person with normal hearing perceives changes in the acoustics of the environment when he turns his head and/or moves in space relative to the sound source. In a wireless hearing assistance system including wireless heating aids and streaming device(s), a static spatialization technique may limit the hearing aid wearer's ability to localize sound/streaming sources. For example, when a diotic signal representing telephone ringing is streamed to the hearing aid wearer, the hearing aid wearer cannot tell from the signal where the ringing telephone is when he needs to locate it for answering. In another example, when the hearing aid wearer is watching and listening to television using streamed audio, while walking to a different room, the streamed audio would not change in a way that reflects the changing distance between the hearing aid wearer and the television set/streaming device. This may become annoying, for example, when the hearing aid wearer is actually trying to switch his attention from the television to other sounds in the house, such as a conversation occurring in the different room he walks into. Though the wireless hearing assistance system may provide the hearing aid wearer with a switch to disable the audio streaming in such situation, this option does not simulate realistic hearing experience, and the hearing aid wearer will likely find this option inconvenient.

The present apparatus and method provide a hearing aid wearer with the option of having audio spatialization effects that reflect the actual acoustics of the environment. For example, if a streaming source is located at a 30° angle from the hearing aid wearer, the streamed audio results in a sound perceived by the hearing aid wearer as coming from a location at that 30° angle. If the hearing aid wearer moves relative to the streaming source (or the streaming source moves relative to the hearing aid wearer), the spatialization effects are dynamically updated to reflect the changing angle and/or distance between the hearing aid wearer and the streaming source.

In various embodiments, the present hearing assistance system uses positioning sensors to determine the location and orientation of a wireless hearing aid set (e.g., a pair of left and right hearing aids) in space relative to streaming sources in real time so that spatialization effects can be applied in real time to the sounds presented to the hearing aid wearer. The sounds are therefore perceived by the hearing aid wearer as being from the locations of the streaming sources. In one embodiment, the positioning sensors include those located in the hearing aid set and/or the streaming sources. In one embodiment, the positioning sensors include those located outside of the hearing aid set and the streaming sources. In various embodiments, the hearing assistance system uses real-time information about a listening environment to determine what spatialization effects to apply, thereby providing a hearing aid user with a listening experience that is substantially similar to that of a person with normal hearing. Such spatialization effects may become more important to the hearing aid wearer with advanced technology allowing multiple audio signals to be simultaneously streamed to the hearing aid set from streaming sources at different locations.

While hearing aids are specifically discussed as an example, the present subject matter is not limited to hearing aids, but may be applied to any wireless streaming audio devices, such as wireless headphones or ear buds, to provide for spatialization effects in audio signals allowing a user to locate streaming or sound sources. In this document, a "user" includes, but is not limited to, a hearing aid wearer.

FIG. 1 is a block diagram illustrating an embodiment of a hearing assistance system 100 that provides for spatial enhancement of streamed audio. System 100 includes a streaming source 101, a hearing aid set 102, a positioning system 103, and a spatialization processor 104. Streaming source 101 is configured to produce an audio signal and stream the audio signal to hearing aid set 102 via a wireless link 106. In various embodiments, streaming source 101 includes a streaming device coupled to or included in a sound source device such as a telephone, radio, television set, music player, computer, or any device that generates sounds. An example of wireless link 106 includes a Bluetooth wireless link. In various embodiments, Bluetooth and/or another suitable wireless communication technology may be used for communication over wireless link 106. Hearing aid set 102 is a wireless hearing aid set configured to receive the streamed audio signal, process the streamed audio signal to produce output sounds, and transmit the output sounds to a hearing aid wearer. The output sounds have a spatialization effect allowing the hearing aid wearer to locate streaming source 101 in space. Positioning system 103 is configured to determine the position of hearing aid set 102 relative to streaming source 101 in real time. Spatialization processor 104 is configured to process the audio signal using the position of hearing aid set 102 relative to streaming source 101 such that the output sounds include the spatialization effect. In various embodiments, positioning system 103 and spatialization processor can be partially or entirely included in streaming source 101 and/or hearing aid set 102.

Figure 2:
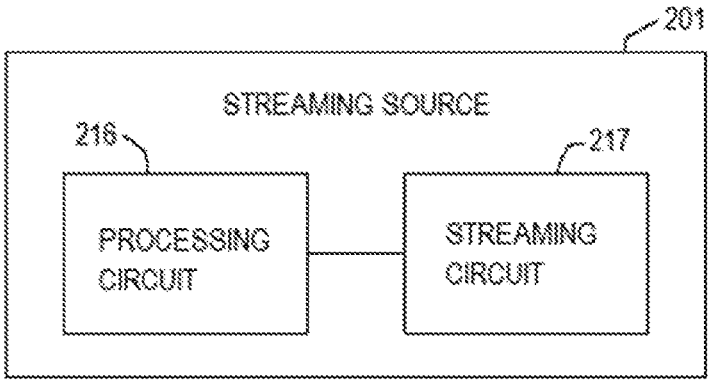
FIG. 2 is a block diagram illustrating an embodiment of a streaming source of the hearing assistance system.

FIG. 2 is a block diagram illustrating an embodiment of a streaming source 201, which represents an embodiment of streaming source 101. Streaming source 201 includes a processing circuit 216 that produces an audio signal and a streaming circuit 217 that streams the audio signal. In various embodiments, streaming source 201 may be a device that is connected to a sound generating device such as a telephone, radio, television set, music player, or computer, or a device being part of the sound generating device.

Figure 3:
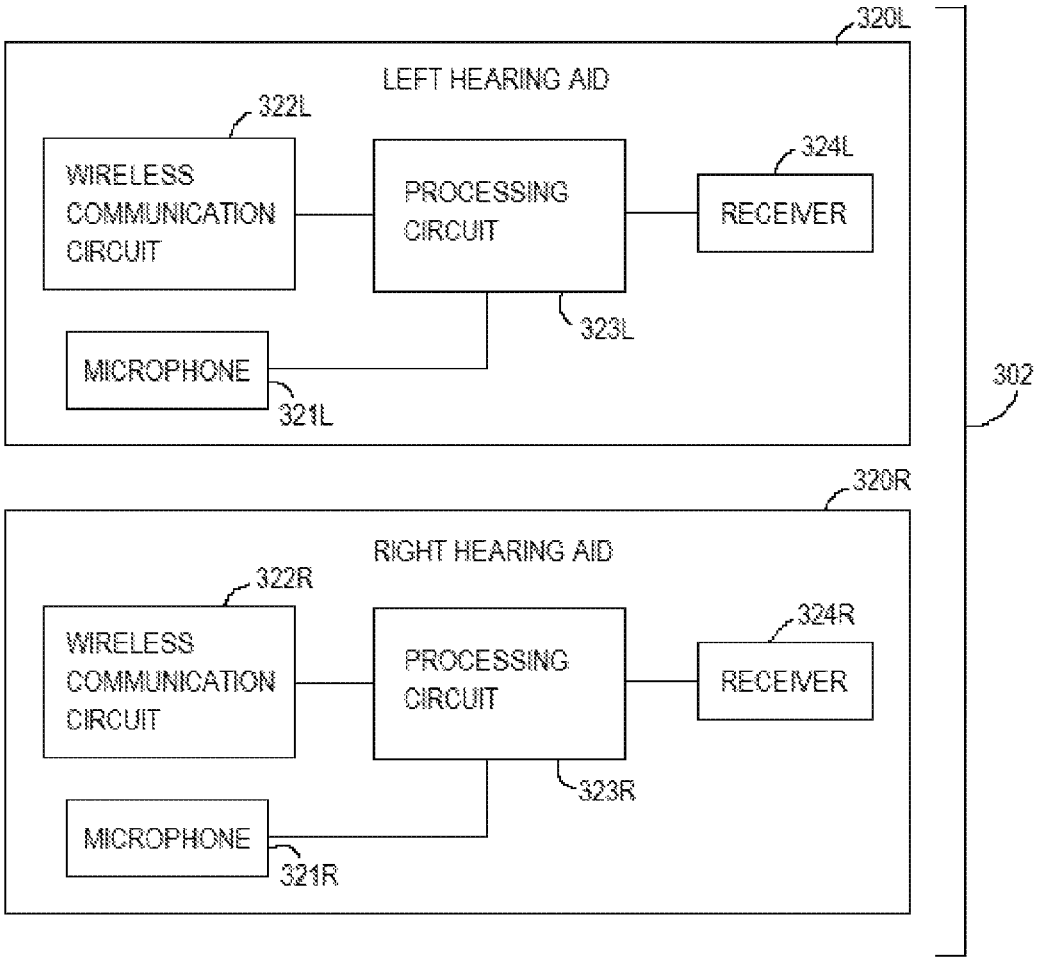
FIG. 3 is a block diagram illustrating an embodiment of a hearing aid set of the hearing assistance system.

FIG. 3 is a block diagram illustrating an embodiment of a hearing aid set 302, which represents an embodiment of hearing aid set 102. Hearing aid set 302 is configured to be communicatively coupled to streaming source 101 or 201 via wireless link 106 and includes a left hearing aid 320L and a right hearing aid 320R.

Left hearing aid 320L includes a microphone 321L, a wireless communication circuit 322L, a processing circuit 323L, and a receiver 324L. Microphone 321L receives sounds from the environment of the hearing aid wearer. Wireless communication circuit 322L communicates with another device wirelessly, including receiving the streamed audio signal from streaming sources 101 or 201 directly or through right hearing aid 320R. Processing circuit 323L processes the sounds received by microphone 321L and/or the streamed audio signal received by wireless communication circuit 322L to produce a left output sound of the output sounds. Receiver 324L transmits the left output sound to the left ear canal of the hearing aid wearer.

Right hearing aid 320R includes a microphone 321R, a wireless communication circuit 322R, a processing circuit 323R, and a receiver 324R. Microphone 321R receives sounds from the environment of the hearing aid wearer. Wireless communication circuit 322R communicates with another device wirelessly, including receiving the streamed audio signal from streaming sources 101 or 201 directly or through left hearing aid 320L. Processing circuit 323R processes the sounds received by microphone 321R and/or the streamed audio signal received by wireless communication circuit 322R to produce a right output sound of the output sounds. Receiver 324R transmits the right output sound to the right ear canal of the hearing aid wearer.

The left and right output sounds when being simultaneously heard by the hearing aid wearer have a spatialization effect allowing the hearing aid user to locate streaming source 101 or 201. The hearing aid wearer perceives the sounds as being from the location of streaming source 101 or 201 rather than from inside the head.

Figure 4:
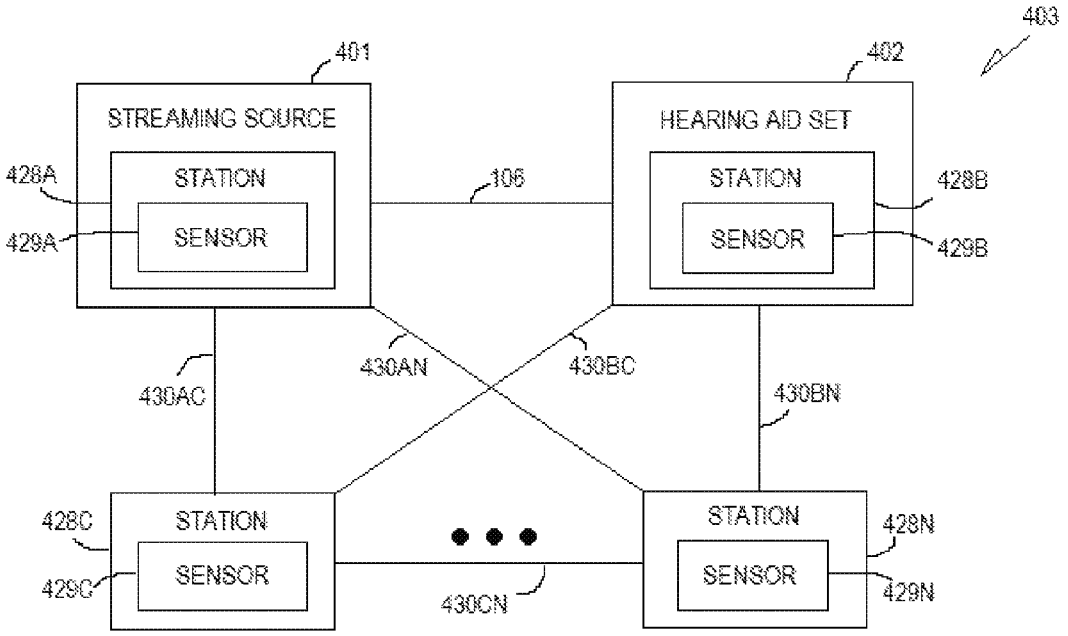
FIG. 4 is a block diagram illustrating an embodiment of a hearing aid positioning system.

FIG. 4 is a block diagram illustrating an embodiment of a hearing aid positioning system 403 that is at least partially distributed in a streaming source 401 and a hearing aid set 402. Positioning system 403 represents an embodiment of positioning system 103 and includes "stations" 428A-N. Streaming source 401 represents an embodiment of streaming source 101 or 201 and includes station 428A. Hearing aid set 402 represents an embodiment of hearing aid set 102 or 302 and includes station 428B. Stations 428C-N are each a standalone device or included in another device such as another streaming source. FIG. 4 illustrates how positioning system 403 can be distributed by way of example and not by way of restriction. In various other embodiments, positioning system 403 includes any one or more stations 1-N each being a standalone device or included in another device such as streaming source 401 or hearing aid set 402. Stations 428A-N each include one of corresponding positioning sensors 429A-N. Sensors 429A-N are each configured to determine one or more parameters indicative of the position of hearing aid set 402 relative to the position of streaming source 401 in real time. Examples of such one or more parameters include a distance between hearing aid set 402 and streaming device 401 and an angle between hearing aid set 402 and streaming device 401 relative to a reference direction (i.e., orientation of hearing aid set 402 relative to streaming device 401).

While some positioning systems may each require at least 3 or 4 stations to determine a position, when outfitted with proper hardware (e.g., orientation sensors and simple radio frequency (RF) ranging sensors), a hearing aid and a streaming device can each act as a station. With more space and processing power, a station can potentially function as two or more stations for short range localization of an object. For example, WiFi antenna diversity and optimal array weighting information have been used to provide position and orientation information. The concept is similar to how multiple microphones can act as a highly directive microphone. Another example includes a sensor such as a gyroscope or other Micro-Electro-Mechanical Systems (MEMS) orientation sensor that can be included in hearing aids to track changes in head position and orientation. These changes are communicated to other stations to for determining the relative position of the hearing aids to the streaming source.

In various embodiments, sensors A-N use RF electromagnetic signals, acoustic signals (such as ultrasonic waves), and/or optical signals to determine the one or more parameters indicative of the position of hearing aid set 402 relative to the position of streaming source 401. Stations 428A-N communicate with one another to gather the necessary parameter values to determine the position. Examples of such one or more parameters include angle-of-arrival (AOA), received-signal strength (RSS), and time of flight (TOF).

AOA represents the direction of propagation of the streamed audio signal (an RF wave) measured using the RF wave incident on a positioning sensor such as a directional antenna or antenna array. In one embodiment, AOA is determined based on time difference of arrival measured between the elements of an antenna array. RSS represents power in the received RF wave that can be used to determine the distance over which the RF wave has traveled using propagation-loss equations. In free space, the propagation loss is proportional to the square of the distance between the transmitter (streaming source 401) and the sensor, and proportional to the square of the frequency of the RF wave. TOF is the propagation time for the RF wave to travel from the transmitter to the sensor, from the sensor to the transmitter, or round-trip between the transmitter and the sensor. In various embodiments, positioning system 403 measures AOA, RSS, TOF, one or more other parameters indicative of the position of hearing aid set 402 relative to streaming source 401, or any combination of two or more of these parameters. For example, positioning system 403 may use AOA to provide the hearing aid wearer with the output sounds indicative of only the direction of the streaming source, use RSS and/or TOF to provide the hearing aid wearer with the output sounds indicative of only the distance from the streaming source, or use AOA and RSS and/or TOE to provide the hearing aid wearer with the output sounds indicative of both the direction of the streaming source and the distance from the streaming source.

Referring back to FIGS. 1-3, upon determination of the positions of hearing aid set 102 (or 302, 402) relative to streaming source 101 (or 201, 401), spatialization processor 104 processes the audio signal using the determined position by applying spatialization to make the output sounds perceived by the hearing aid wearer as they are coming from the direction of streaming source 101. In various embodiments, spatialization processor 104 is implemented in streaming source 101 (as part of processing circuit 216), hearing aid set 102 (as part of processing circuits 323L and/or 323R), or distributed in both streaming source 101 (processing circuit 216) and hearing aid set 102 (processing circuits 323L and/or 323R). In one embodiment, streaming source 101 includes spatialization processor 104, which is configured to spatially enhance the audio signal using the positions of hearing aid set 102 relative to streaming source 101 before streaming the audio signal, and hearing aid set 102 receives and processes the spatially enhanced and streamed audio signal to produce the output sounds including the spatialization effect. In another embodiment, hearing aid set 102 includes spatialization processor 104, which is configured to spatially enhance the received streamed audio signal using the positions of hearing aid set 102 relative to streaming source 101, and processes the spatially enhanced streamed audio signal to produce the output sounds include the spatialization effect. In various embodiments, the real time determination of the position of hearing aid set 102 relative to streaming source 101 by positioning system 103 (or 403) allows for the spatialization effect to be applied by spatialization processor 104 in real time.

In one embodiment, spatialization processor 104 is configured to spatially enhance the audio signal using predefined time delays and/or predefined level differences associated with the determined position of hearing aid set 102 relative to streaming source 101. In another embodiment, spatialization processor 104 is configured to spatially enhance the audio signal using the hearing-aid wearer's individual characteristics represented by HRTFs. One example of implementing individualized HRTFs uses head-related impulse responses (HRIRs), which are the time domain versions of HRTFs (which are defined in the frequency domain). A small set of anthropometric measurements can be taken and entered into a structural model, also referred to as an HRIR-generating model. A small amount of fine-tuning can be performed to improve the spatialization for the particular hearing aid wearer.

In one embodiment, spatialization processor 104 adds reverberation to the audio signal. In real life, an audio signal also takes on different characteristics associated with, for example, the size of a room and materials in the room. Therefore, it is worthwhile under certain circumstances to add reverberation to the streamed audio signal. In one embodiment, spatialization processor 104 adds artificial reverberation using constant parameters that are predefined for a streaming environment. In another embodiment, system 100 provides the hearing aid wearer several reverberation options to select from. These options each simulate, for example, a different room type (such as defined by different sizes and/or different materials of the room). In one embodiment, streaming device 101 and/or hearing aid set 102 monitor the listening environment and extract reverberation parameters for application to the audio signal. Examples of such reverberation parameters include times and/or levels at which the first, second, third, etc. echoes occur). In one embodiment, hearing aid set 102 monitors the listening environment, for example through existing dereverberation algorithms, and transmits reverberation parameters to streaming source 101, which then applies the reverberation parameters to the audio signal.

Figure 5:
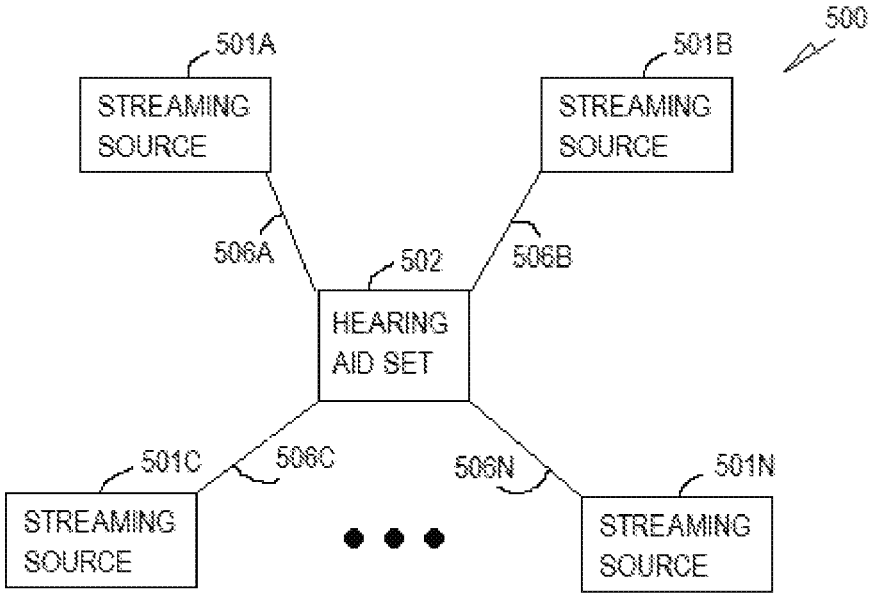
FIG. 5 is a block diagram illustrating another embodiment of the hearing assistance system including multiple streaming devices.

FIG. 5 is a block diagram illustrating another embodiment of a hearing assistance system 500, which represents an embodiment of system 100 and includes multiple streaming sources 501A-N. System 500 is capable of handling multiple audio streams, i.e., audio signals streamed from streaming devices 501A-N to a hearing aid set 502, simultaneously. Hearing aid set 502 receives and processes the streamed audio signals and produces output sounds such that the heating aid wearer may hear sounds from different sources simultaneously.

In one embodiment, system 500 applies the same spatialization technique with respect to each of streaming sources 501A-N. In another embodiment, system 500 applies an individually selected spatialization technique with respect to each of streaming sources 501A-N. When multiple streaming sources are present, different spatialization techniques may be applied, depending on the distances each between the heating aid wearer and one of the streaming sources. For example, a relatively advanced form of spatialization may be applied for the streaming source that is located closest to the hearing aid wearer, while a relatively simple spatialization technique may be applied for a streaming source that is located farther from the hearing aid wearer. Examples of spatialization techniques include, but are not limited to, the positioning and spatialization aspects discussed throughout this document.

Figure 6:
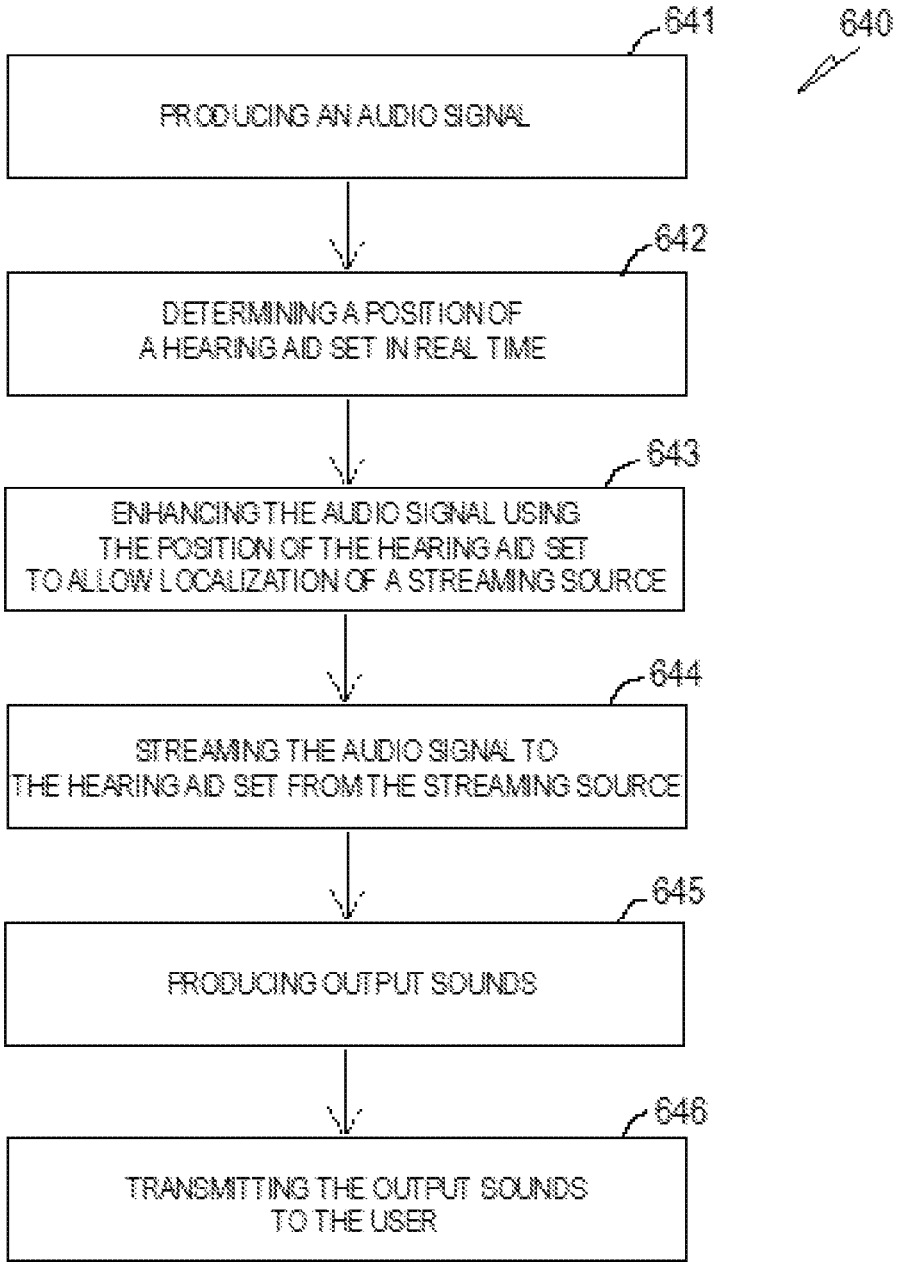
FIG. 6 is a flow chart illustrating an embodiment of a method for spatially enhancing streamed audio.

FIG. 6 is a flow chart illustrating an embodiment of a method 640 for spatially enhancing streamed audio. In one embodiment, method 640 is performed by system 100, including the various embodiments of its elements as discussed with reference to FIGS. 1-5.

At 641, an audio signal is produced at a streaming source. The audio signal is to be streamed to a hearing aid set that produces output sounds to be heard by a hearing aid wearer using the streamed audio signal. At 642, the position of the hearing aid set relative to the streaming source is determined in real time. In one embodiment, this includes using one or more sensors each receiving an incident signal and sensing one or more parameters of the received incident signal. The one or more parameters each indicate an orientation of the hearing aid set relative to the streaming source or a distance between the hearing aid set and the streaming source. Examples of the one or more parameters include an AOA of the incident signal, an RSS of the incident signal, and a TOF associated with the incident signal. In various embodiments, the sensors may each be included in the streaming source, included in the hearing aid set, or a device separate from the streaming source and the hearing aid set. In one embodiment, one or more additional audio signals are streamed to the hearing aid set from one or more additional streaming sources simultaneously with the audio signal, and the position of the hearing aid set relative to each of the streaming sources are determined in real time.

At 643, the audio signal is enhanced using the position of the hearing aid set relative to the streaming source such that output sounds include a spatialization effect allowing the hearing aid wearer to locate the streaming source. At 644, the audio signal is streamed to the hearing aid set from the streaming source. It is noted that steps 641-646 are not necessarily performed in the order shown in FIG. 6. In one embodiment, the audio signal is enhanced for the spatialization effect at 643 using a processing circuit of the streaming source, and then streamed to the hearing aid set at 644. In another embodiment, the audio signal is streamed to the hearing aid set from the streaming source at 644, and then enhanced for the spatialization effect using a processing circuit of the hearing aid set. In one embodiment, in which multiple audio signals are streamed from multiple streaming sources, one or more of the multiple audio signals may be selected to be each enhanced using the position of the hearing aid set relative to the corresponding streaming source such that the output sounds include a spatialization effect allowing the user to locate each of one or more streaming sources from which the selected one or more audio signals are streamed.

At 645, the output sounds are produced using the audio signal. In one embodiment, the hearing aid set includes a left heading aid and a right hearing aid, and the output sounds include a left output sound for transmission to the left ear canal of the hearing aid wearer using the left hearing aid and a right output sound for transmission to the right ear canal of the hearing aid wearer using the tight hearing aid. In one embodiment, the output sounds are produced by determining a time delay and/or a level difference between the left output sound and the right output sound using the position of the hearing aid set relative to the streaming source and spatially enhancing the audio signal to introduce the time delay and/or the level difference between the left output sound and the right output sound. In one embodiment, the output sounds are produced by determining one or more differences between the left output sound and the right output sound using head-related transfer functions and the position of the hearing aid set relative to the streaming source, and spatially enhancing the audio signal to introduce the one or more differences between the left output sound and the right output sound. In one embodiment, reverberated is added to the audio sounds. For example, the environment of the hearing aid set is monitored, and reverberation is added to the audio signal based on an outcome of the monitoring. In one embodiment, in which multiple audio signals are streamed from multiple streaming sources, the output sounds are produced using the multiple audio signals including the one or more audio signals selected to be enhanced for the spatialization effect. At 646, the output sounds are transmitted to the ear canals of the hearing aid wearer using the hearing aid set.

In various embodiments, the circuit of system 100, including the various embodiments of its elements discussed in this document, is implemented using hardware, software, or a combination of hardware and software. In various embodiments, processing circuits such as circuits in positioning system 103, spatialization processor 104, and processing circuits 216, 323L, and 323R, may be implemented using one or more circuits specifically constructed to perform one or more functions discussed in this document or one or more general-purpose circuits programmed to perform such one or more functions. Examples of such general-purpose circuit can include a microprocessor or a portion thereof, a microcontroller or portions thereof, and a programmable logic circuit or a portion thereof.

The present subject matter is demonstrated for hearing assistance devices, including hearing aids, including but not limited to, behind-the-ear (BTE), receiver-in-canal (RIC), in-the-ear (ITE), in-the-canal (ITC), completely-in-the-canal (CIC), or invisible-in-the-canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. It is understood that other hearing assistance devices not expressly stated herein may be used in conjunction with the present subject matter.

While intended for hearing-impaired individuals, the present subject matter can also be used by people with normal hearing who wish to receive the streamed signal(s) in the manner as discussed in this document. For example, the present subject matter can be used in personal sound amplification products (PSAPs). The streaming sources discussed in this document may include those owned by the hearing aid wearer (e.g., prescribed for a particular hearing aid set) and/or those made available for public use. Users of the present subject matter will experience assisted listening that is consistent with a natural sense of space and thus more transparent and pleasing to use.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for operating a set of hearing assistance devices configured to be worn by a wearer having a left ear and a right ear, the method comprising:

receiving an audio signal from a streaming source;

producing a left output sound for transmission to the left ear and a right output sound for transmission to the right ear using the received signal, including:

determining a position of the set of hearing assistance devices relative to the streaming source;

determining one or more differences between the left output sound and the right output sound using the wearer's head-related transfer functions and the position of the set of hearing assistance devices relative to the streaming source, the one or more differences providing for a spatialization effect allowing the wearer to locate the streaming source;

implementing the wearer's head-related transfer functions using head-related impulse responses; and introducing the one or more differences to at least one of the left output sound and the right output sound; and transmitting the left output sound to the left ear and the right output sound to the right ear using the set of hearing assistance devices.

2. The method of claim 1, wherein determining the position of the set of hearing assistance devices relative to the streaming source comprises determining the position of the set of hearing assistance devices relative to the streaming source in real time.

3. The method of claim 2, wherein determining the position of the set of hearing assistance devices relative to the streaming source comprises determining the position of the set of hearing assistance devices relative to the streaming source using one or more positioning sensors in the set of hearing assistance devices.

4. The method of claim 3, wherein determining the position of the set of hearing assistance devices relative to the streaming source comprises determining a distance between the set of hearing assistance devices and the streaming source.

5. The method of claim 3, wherein determining the position of the set of hearing assistance devices relative to the streaming source comprises determining an orientation of the set of hearing assistance devices relative to the streaming source.

6. The method of claim 3, wherein determining the position of the set of hearing assistance devices relative to the streaming source comprises determining the position of the set of hearing assistance devices relative to the streaming source using one or more position sensors in the streaming device.

7. The method of claim 1, wherein determining the one or more differences between the left output sound and the right output sound comprises determining a time delay between the left output sound and the right output sound.

8. The method of claim 1, wherein determining the one or more differences between the left output sound and the right output sound comprises determining a level difference between the left output sound and the right output sound.

9. The method of claim 8, wherein determining the one or more differences between the left output sound and the right output sound comprises determining a time delay between the left output sound and the right output sound and the level difference between the left output sound and the right output sound.

10. A system for transmitting sounds to a user having a left ear and a right ear by using a streaming device configured to produce and stream an audio signal, the system comprising:

a set of left and right hearing assistance devices configured to receive the streamed audio signal via a wireless link, process the streamed audio signal to produce a left output sound and a right output sound, and transmit the left output sound to the left ear and the right output sound to the right ear;

a positioning system configured to determine the position of the set of left and right hearing assistance devices relative to the streaming source; and a spatialization processor configured to determine one or more differences between the left output sound and the right output sound using the wearer's head-related transfer functions and the position of the set of hearing assistance devices relative to the streaming source and introduce the one or more differences to at least one of the left output sound and the right output sound, the one or more differences providing for a spatialization effect allowing the user to locate the streaming source, the wearer's head-related transfer functions implemented using head-related impulse responses.

11. The system of claim 10, wherein the set of left and right hearing assistance devices comprises at least a portion of the positioning system.

12. The system of claim 11, wherein the set of left and right hearing assistance devices comprises a positioning sensor configured to sense a distance between the set of hearing assistance devices and the streaming source.

13. The system of claim 11, wherein the set of left and right hearing assistance devices comprises a positioning sensor configured to sense an orientation of the set of hearing assistance devices relative to the streaming source.

14. The system of claim 13, wherein the positioning sensor is configured to sense the orientation of the set of hearing assistance devices relative to the streaming source and a distance between the set of hearing assistance devices and the streaming source.

15. The system of claim 11, wherein the set of left and right hearing assistance devices comprises the spatialization processor.

16. The system of claim 15, wherein the spatialization processor is further configured to add reverberation to the audio signal.

17. The system of claim 11, wherein the positioning system is configured to determine the position of the set of left and right hearing assistance devices relative to the streaming source in real time.

18. The system of claim 17, wherein the set of left and right hearing assistance devices comprises a set of hearing aids.

19. The system of claim 17, wherein the set of left and right hearing assistance devices comprises a set of headphones or a set of ear buds.

20. The method of claim 1, wherein determining the position of the set of hearing assistance devices relative to the streaming source comprises determining a distance between the set of hearing assistance devices and the streaming source.

* * * * *